US008639168B2

(12) United States Patent
Pickering et al.

(10) Patent No.: US 8,639,168 B2
(45) Date of Patent: Jan. 28, 2014

(54) PRODUCING GLOSS-WATERMARK PATTERN ON FIXING MEMBER

(75) Inventors: Jerry Alan Pickering, Hilton, NY (US); Donald Saul Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 127 days.

(21) Appl. No.: 13/362,267

(22) Filed: Jan. 31, 2012

(65) Prior Publication Data

US 2013/0195521 A1 Aug. 1, 2013

(51) Int. Cl.
*G03G 15/20* (2006.01)

(52) U.S. Cl.
USPC ..... 399/320; 399/330; 399/333; 399/341

(58) Field of Classification Search
USPC ..... 399/320, 330, 331, 333, 341; 219/216; 427/370, 472
See application file for complete search history.

(56) References Cited

U.S. PATENT DOCUMENTS

| | | | | |
|---|---|---|---|---|
| 6,916,583 | B1 * | 7/2005 | Landa et al. | 430/11 |
| 7,286,685 | B2 | 10/2007 | Brunk et al. | |
| 7,555,139 | B2 | 6/2009 | Rhoads et al. | |
| 7,867,678 | B2 * | 1/2011 | Ciaschi et al. | 430/108.1 |
| 8,496,998 | B2 * | 7/2013 | Pickering et al. | 427/472 |
| 2008/0192297 | A1 | 8/2008 | Wang et al. | |
| 2008/0193860 | A1 | 8/2008 | Hains | |
| 2008/0280035 | A1 | 11/2008 | Jao et al. | |
| 2010/0128321 | A1 | 5/2010 | Wang et al. | |
| 2010/0151068 | A1 | 6/2010 | Hurst et al. | |

* cited by examiner

*Primary Examiner* — Hoang Ngo
(74) *Attorney, Agent, or Firm* — Christopher J. White

(57) ABSTRACT

A gloss-watermark pattern is produced on a rotatable fixing member including a thermoplastic layer having a surface and a selected thickness. Particles having a Young's modulus of at least 1 GPa are applied in a selected deposition pattern to a selected area of a pressure member. The pressure member and the fixing member are pressed together so that the applied particles indent the surface of the fixing member to form the gloss-watermark pattern. The pressure member and the fixing member can then be mechanically separated and a printed image on a receiver can be fixed using the fixing member having the gloss-watermark pattern. A gloss watermark corresponding to the gloss-watermark pattern is thus formed on the printed image.

12 Claims, 8 Drawing Sheets

FIG. 4A
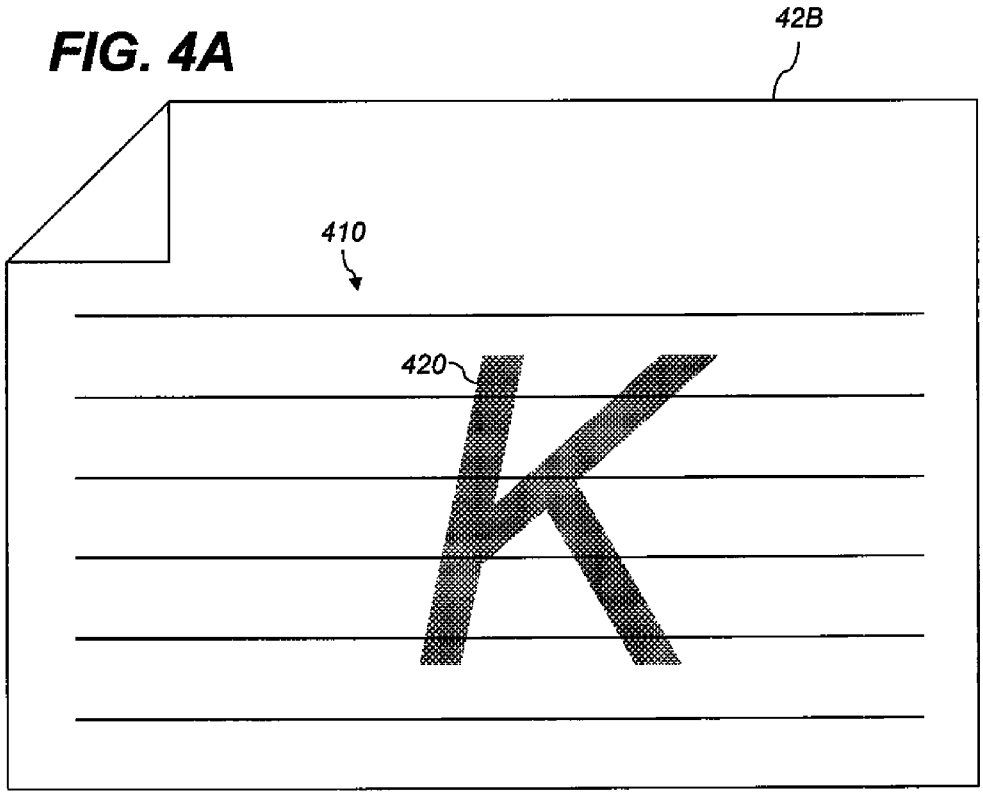
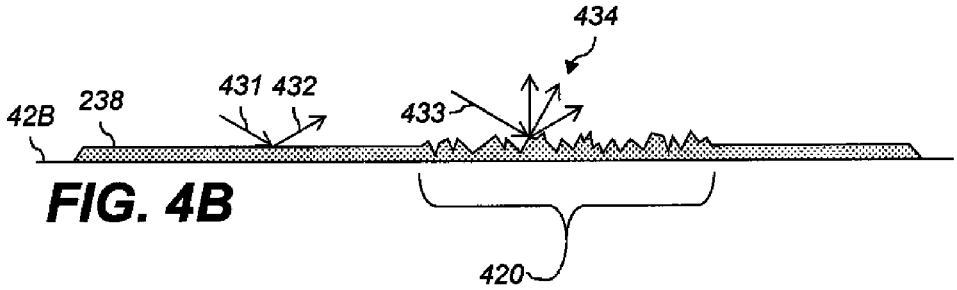
FIG. 4B
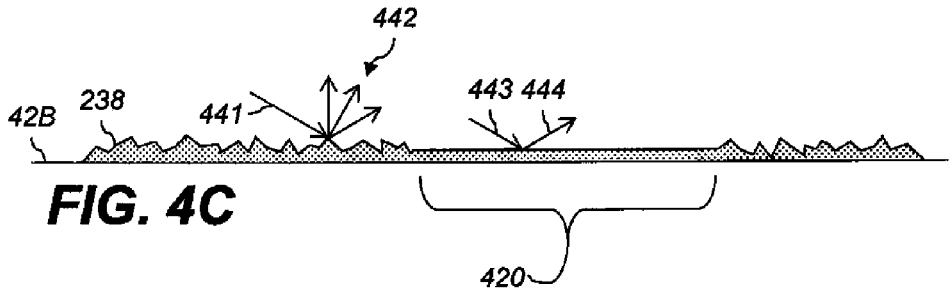
FIG. 4C

PRODUCING GLOSS-WATERMARK PATTERN ON FIXING MEMBER

CROSS-REFERENCE TO RELATED APPLICATIONS

This application is co-filed with and has related subject matter to U.S. patent application Ser. No. 13/362,257 filed Jan. 31, 2012, titled "PRODUCING GLOSS-WATERMARK PATTERN ON FIXING ROLLER," by Pickering, et al. which is incorporated herein by reference; U.S. patent application Ser. No. 13/303,520, filed Nov. 23, 2011, titled "PRODUCING GLOSS WATERMARK ON RECEIVER" by Pickering et al.; and U.S. patent application Ser. No. 13/303,542, filed Nov. 23, 2011, titled "GLOSS-WATERMARK-PRODUCING APPARATUS" by Pickering et al.

FIELD OF THE INVENTION

This invention pertains to the field of printing and more particularly to producing patterns on fixing rollers useful for producing gloss watermarks on prints.

BACKGROUND OF THE INVENTION

Printers are useful for producing printed images of a wide range of types. Printers print on receivers (or "imaging substrates"), such as pieces or sheets of paper or other planar media, glass, fabric, metal, or other objects. Printers typically operate using subtractive color: a substantially reflective receiver is overcoated image-wise with cyan (C), magenta (M), yellow (Y), black (K), and other colorants. Prints can be produced with various surface finishes such as matte or glossy.

For security, watermarks are often provided on documents that should not be reproduced or counterfeited. A watermark is a pattern visible in the original document under some viewing conditions but not others. For example, cylinder-mold and dandy-roll watermarks vary the thickness of the paper in a pattern corresponding to the watermark. Thinner areas of the paper permit more light to pass through than thicker areas of the paper, so the watermark is visible when backlit. However, the watermark is generally not visible when front-lit. The watermark is therefore not copyable by typical office copiers, flatbed scanners, or devices that image the piece to be copied under front-lit conditions.

However, conventional watermarks require custom paper. In an attempt to provide watermarks that can be produced on standard papers, various schemes have been proposed that modify the image data to be printed. For example, U.S. Patent Publication No. 2008/0192297 describes using anisotropic halftone structures with different orientations to render different parts of an image. This document describes providing different gloss characteristics between the parts of the image printed with the different halftone structures. U.S. Patent Publication No. 2008/0193860 describes a similar technique. U.S. Patent Publication No 2010/0128321 describes modulating image content for a contone image according to different polarizations (i.e., halftone screen orientations) to produce differential gloss effects. U.S. Pat. No. 7,555,139 describes adjusting line width or line spacing of a security pattern to carry data. U.S. Pat. No. 7,286,685 describes modifying a stochastic halftone pattern to incorporate a watermark.

However, these schemes require the image data to be modified using specific halftone patterns. Changing halftone patterns changes the appearance of the rendered image in more ways than simply gloss. For example, in a dot screen, the apparent densities of fine lines, as viewed by eye, vary by a certain amount depending on the angle between the line and the screen angle. In a line screen, however, the variation in apparent densities is much more significant. Fine lines substantially parallel to the line-screen angle will appear substantially solid, and fine lines substantially perpendicular to the line-screen angle will appear dotted or dashed. Using a dot screen, in contrast, fine lines either parallel or perpendicular would appear dashed.

Other schemes produce watermarks using specialized watermarking materials. Examples of such materials include colorless toners, colorless ink jet inks, and inks or toners containing specialty materials that are detectable under various special lighting conditions but that are not normally observable to the human eye. Another specialized material is an ink containing a solvent that softens fused toner. This softening changes the gloss of the softened toner. However, these schemes either require special-purpose watermarking machines or occupy space in the printer that could otherwise be used for producing visible images.

There is a continuing need, therefore, for a way of producing a gloss watermark that does not corrupt the intended appearance of the image content, and that permits producing high-quality images without specialized watermarking stations. Moreover, there is a continuing need for a way of producing such watermarks that permits the watermark to be changed from image to image.

SUMMARY OF THE INVENTION

According to an aspect of the present invention, there is provided a method of producing a gloss-watermark pattern on a rotatable fixing member including a thermoplastic layer having a surface and a selected thickness, the method comprising:

applying particles having a Young's modulus of at least 1 GPa in a selected deposition pattern to a selected area of a pressure member; and pressing the pressure member and the fixing member together so that the applied particles indent the surface of the fixing member to form the gloss-watermark pattern.

An advantage of this invention is that it provides a fixing member that can be used to produce a variety of gloss watermarks. In various embodiments, for each image, a gloss watermark corresponding to the content of that image is produced. The gloss watermarks can be provided without modifying the image content. Since a watermarking fixing roller is used, watermarking does not occupy a color channel in the printer, nor does it require specialty materials. The gloss watermark can be provided on many different papers and other substrates, and does not require custom watermark paper or the attendant storage and logistical costs of that paper. Producing the watermark does not slow down the printer. Some prior-art schemes require clear toner be deposited to form the gloss watermark, but the fixing members of various embodiments herein can produce a gloss watermark in colored toner, and do not require clear toner. Various embodiments of applying particles permit hardware similar to that of the printer to be used; for example, inkjet particle application can be used in inkjet printers. Various embodiments use water-soluble particles, providing simple cleanup without requiring special facilities for the disposal of waste particles. Various embodiments provide fixing members useful for producing watermarks on electrophotographically-produced prints. Production of a gloss watermark using such a fixing member does not require a dedicated toner or toner deposition or development station, or a fuser roller or watermarking subsystem separate from the fixing member itself. The gloss-watermark pattern can be removed from the fixing member after fixing to provide different gloss watermarks for different prints. In various embodiments, the gloss-watermark pattern is changed before or after each print, e.g., to provide a gloss-watermark pattern including a serial number or other unique per-sheet or per-job identification.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein:

FIG. 4A is a plan, and FIGS. 4B-4C side views, of a receiver bearing a gloss watermark according to various examples;

Figure 1:
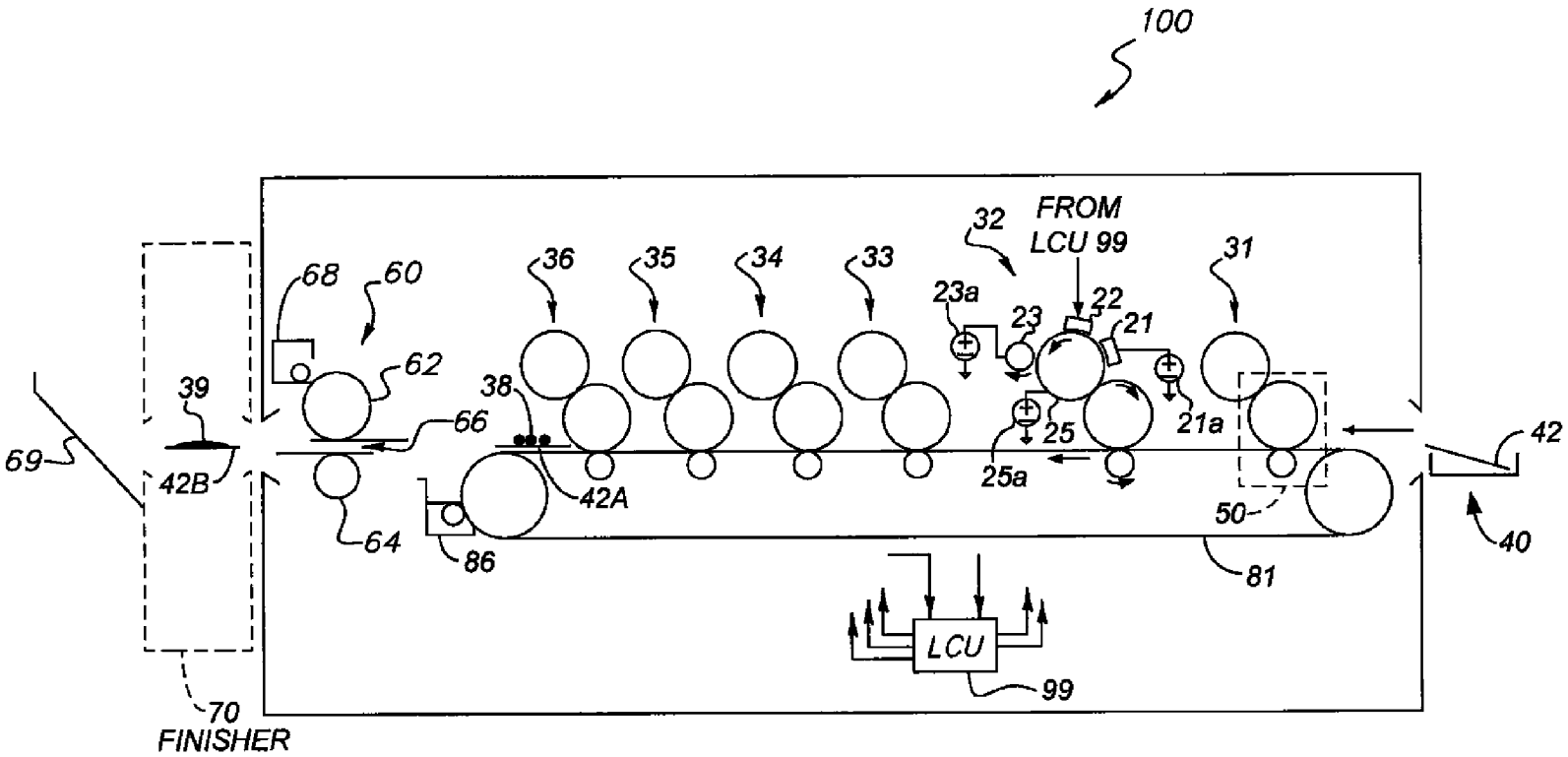
FIG. 1 is an elevational cross-section of an electrophotographic reproduction apparatus.

The attached drawings are for purposes of illustration and are not necessarily to scale.

DETAILED DESCRIPTION OF THE INVENTION

The electrophotographic (EP) printing process can be embodied in devices including printers, copiers, scanners, and facsimiles, and analog or digital devices, all of which are referred to herein as "printers." Electrostatographic printers such as electrophotographic printers that employ toner developed on an electrophotographic receiver are used, as well as ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and Lk, but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

FIG. 1 is an elevational cross-section showing portions of a typical electrophotographic printer 100. Printer 100 is adapted to produce print images, such as single-color (monochrome), CMYK, or hexachrome (six-color) images, on a receiver (multicolor images are also known as "multi-component" images). Images can include text, graphics, photos, and other types of visual content. An embodiment involves printing using an electrophotographic print engine having six sets of single-color image-producing or -printing stations or modules arranged in tandem, but more or fewer than six colors are combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, 36, also known as electrophotographic imaging subsystems. Each printing module 31, 32, 33, 34, 35, 36 produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver 42, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film. A receiver can be in sheet or roll form.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and toning station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning station 23 and are attracted to the latent image to develop the latent image into a visible image. Note that the visible image may not be visible to the naked eye depending on the composition of the toner particles (e.g. clear toner). Toning station 23 can also be referred to as a development station. Toner can be applied to either the charged or discharged parts of the latent image.

After the latent image is developed into a visible image on photoreceptor 25, a suitable receiver 42 is brought into juxtaposition with the visible image. In transfer subsystem 50, a suitable electric field is applied to transfer the toner particles of the visible image to receiver 42 to form on the receiver the desired print image, which is composed of marking material 38, as shown on receiver 42A. The imaging process is typically repeated many times with reusable photoreceptors 25.

Receiver 42A is then removed from its operative association with photoreceptor 25 and subjected to heat or pressure to permanently fix ("fuse") marking material 38 of the print image to receiver 42A. Plural print images, e.g. of separations of different colors, are overlaid on one receiver before fusing to form a multi-color print image on receiver 42A.

Each receiver 42, during a single pass through the six printing modules 31, 32, 33, 34, 35, 36, can have transferred in registration thereto up to six single-color toner images to form a pentachrome image. As used herein, the term "hexachrome" implies that in a print image, combinations of various of the six colors are combined to form other colors on receiver 42 at various locations on receiver 42. That is, each of the six colors of toner can be combined with toner of one or more of the other colors at a particular location on receiver 42 to form a color different than the colors of the toners combined at that location. In an embodiment, printing module 31 forms black (K) print images, printing module 32 forms yellow (Y) print images, printing module 33 forms magenta (M) print images, printing module 34 forms cyan (C) print images, printing module 35 forms light-black (Lk) images, and printing module 36 forms clear images.

In various embodiments, printing module 36 forms the print image using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 36. In these embodiments, marking material 38 on receiver 42A includes unfused toner particles.

Subsequent to transfer of the respective print images, overlaid in registration, one from each of the respective printing modules 31, 32, 33, 34, 35, 36, receiver 42A is advanced to a fixing station 60, i.e. a fusing or fixing assembly, to fuse marking material 38 to receiver 42A. Transport web 81 transports the print-image-carrying receivers (e.g., 42A) to fixing station 60, which fixes the toner particles to the respective receivers 42A by the application of heat and pressure. The receivers 42A are serially de-tacked from transport web 81 to permit them to feed cleanly into fixing station 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fixing station 60 includes a heated fixing member 62 and an opposing pressure member 64 that form a fixing nip 66 therebetween. In an embodiment, fixing station 60 also includes a release fluid application substation 68 that applies release fluid, e.g. silicone oil, to fixing member 62. Alternatively, wax-containing toner is used without applying release fluid to fixing member 62. Other embodiments of fusers, both contact and non-contact, can be employed. For example, solvent fixing uses solvents to soften the toner particles so they bond with the receiver 42. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42.

The receivers (e.g., receiver 42B) carrying the fused image (e.g., fused image 39) are transported in a series from the fixing station 60 along a path either to a remote output tray 69, or back to printing modules 31, 32, 33, 34, 35, 36 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fixing stations 60 to support applications such as overprinting, as known in the art.

In various embodiments, between fixing station 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fixing nip 66 and other operating parameters of fixing station 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid between the corona wires (not shown) and photoreceptor 25. Voltage source 21*a* applies a voltage to the grid to control charging of photoreceptor 25. In an embodiment, a voltage bias is applied to toning station 23 by voltage source 23*a* to control the electric field, and thus the rate of toner transfer, from toning station 23 to photoreceptor 25. In an embodiment, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Figure 2:
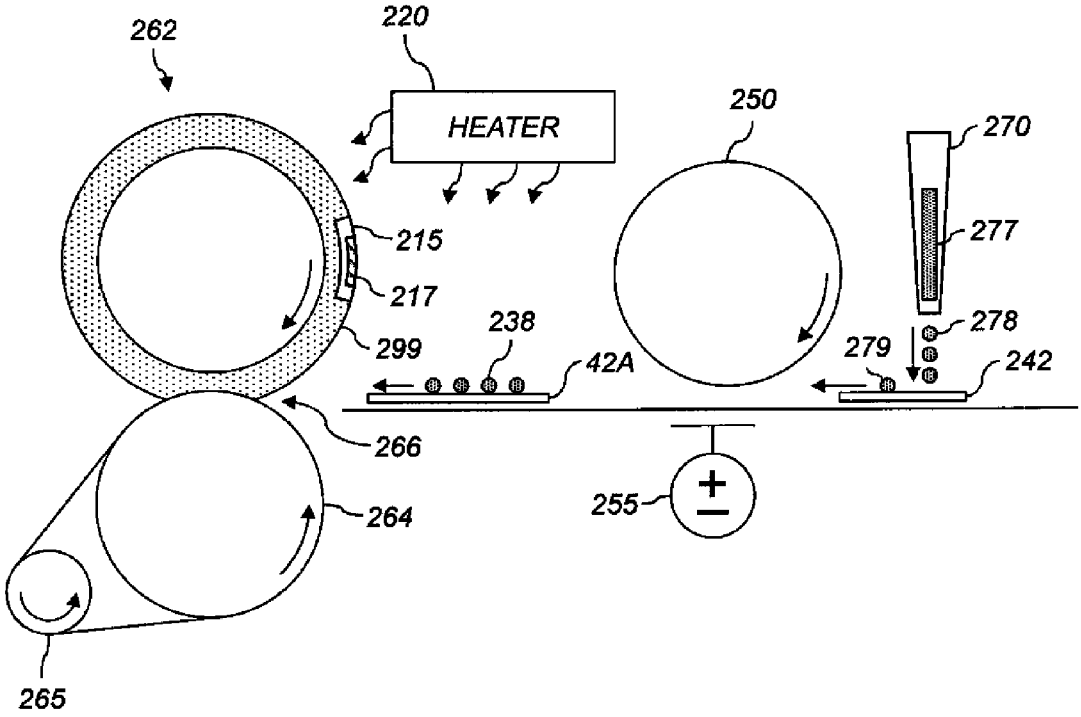
FIG. 2 shows apparatus for producing a gloss watermark on a receiver bearing heat-softenable marking material.

FIG. 2 shows apparatus for producing a gloss watermark on receiver 42A bearing heat-softenable marking material 238.

Rotatable fixing member 262, which can be a roller (circular in cross-section or not) or belt, has gloss-watermark pattern 217 (e.g., a texture, or a roughened area) in selected area 215. In various embodiments, the surface roughness of fixing member 262 in gloss-watermark pattern 217 is different than the surface roughness of fixing member 262 outside gloss-watermark pattern 217. The portion of the surface of fixing member 262 outside selected area 215 is surround 299.

Heater 220 selectively heats fixing member 262 or receiver 42A. Heater 220 can be a contact or non-contact heater. It can apply heat, electromagnetic radiation (e.g., infrared light), or time-varying electric or magnetic fields to fixing member 262 or receiver 42A. Marking material 238, e.g., toner, is disposed on or over receiver 42A.

Rotatable pressure member 264 is arranged to form fixing nip 266 with fixing member 262. Fixing nips are discussed further above with respect to FIG. 1.

Drive 265 is adapted to rotate fixing member 262 or pressure member 264 to draw receiver 42A through fixing nip 266. Receiver 42A is drawn through fixing nip 266 after fixing member 262 or receiver 42A is heated. As a result, marking material 238 on receiver 42A flows and acquires a gloss watermark in a differentiated region on the receiver corresponding to gloss-watermark pattern 217 of fixing member 262. The gloss in the differentiated region is different than the gloss of marking material 238 outside the differentiated region. This creates the gloss watermark on the surface of marking material 238 on receiver 42A; the gloss difference is visible under appropriate illumination. This is discussed further below with respect to FIGS. 4A-4C.

In various embodiments, a marking-material-bearing member 250 transfers the marking material to the receiver. Member 250 can be a belt or drum and can have a rigid or compliant surface. In various embodiments, source 255 produces an electrostatic field that urges marking material 238 from marking-material-bearing member 250 to receiver 42A. Source 255 can provide an AC or DC bias, or both superimposed, either steady or time-varying. In various embodiments, the marking material is or includes toner. Source 255 can be a photoreceptor or transfer member, as described above with respect to FIG. 1.

In various embodiments, jetting unit 270 jets molten marking material 278 onto receiver 242. Marking material 278 is molten when jetted, and freezes (i.e., cools below its melting temperature) on or shortly after contact with receiver 242 to form solid marking material 279. In various embodiments, jetting unit 270 is a phase-change inkjet or hot-melt inkjet unit. Solid marking material 277 is supplied to jetting unit 270, which melts solid marking material 277 and jets the resulting molten marking material 278 onto receiver 242. Examples of such systems are provided in U.S. Pat. No. 4,992,806 to Peer, U.S. Pat. No. 4,459,601 to Hawkins, and U.S. Pat. No. 4,593,292 to Lewis, all of which are incorporated herein by reference. In these embodiments, fixing member 262 is a spreading member that re-melts solid marking material 279 and applies pressure to level the height profile of the drops of solid marking material 279. In various embodiments of liquid electrophotography, fixing member 262 is a transfusing roller that transfers toner, while simultaneously fixing the toner, from a photoreceptor to a receiver.

Figure 3:
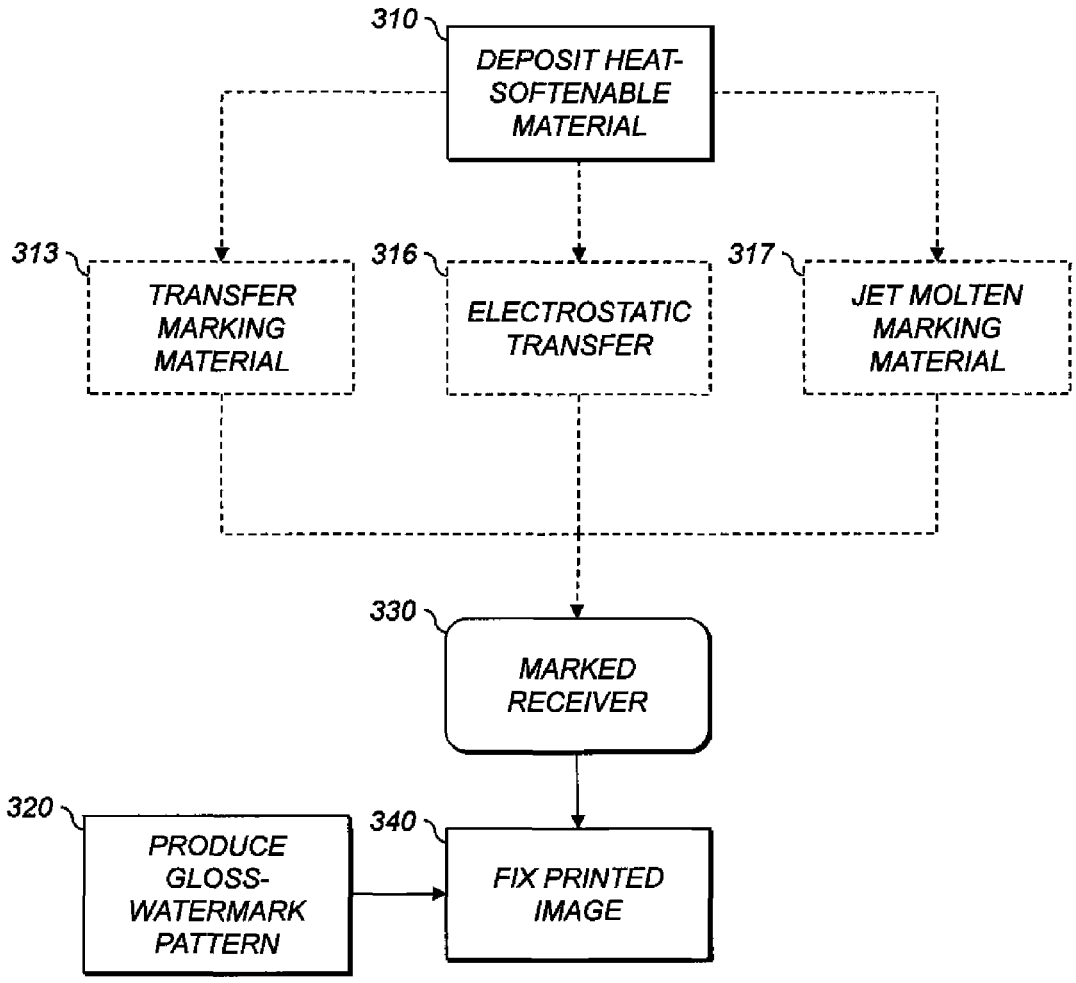
FIG. 3 is a flowchart of various methods for producing gloss watermarks.

FIG. 3 is a flowchart of various methods for producing, on receivers, print images having gloss watermarks. Processing begins with step 310 or step 320.

In step 310, heat-softenable marking material is deposited onto a receiver. The result of step 310 is marked receiver 330, i.e., a receiver bearing a printed image 330 including the deposited heat-softenable marking material. In various embodiments, deposition can be performed as described below with reference to steps 313, 316, and 317. Step 310 is followed by step 340.

In optional step 313, in various embodiments, marking material is transferred from a marking-material-bearing member to the receiver. Transfer can be performed mechanically, electrostatically, magnetically, thermally (e.g., thermal dye sublimation), or pneumatically. Step 313 is followed by step 340.

In optional step 316, in various embodiments, the marking material is transferred by application of an electrostatic field that urges the marking material from a marking-material-bearing member or marking-material-containing vessel to the receiver. For example, the marking material can be or include toner and the deposition can be performed by electrophotographic printing, as described above with respect to FIG. 1. Various embodiments use an electrophotographic printer, e.g., a dry electrophotographic printer, to electrostatically transfer toner marking material to the receiver. Step 316 is followed by step 340.

In optional step 317, in various embodiments, molten marking material is jetted onto the receiver. This jetting is performed as discussed above with respect to jetting unit 270 (FIG. 2). Step 317 is followed by step 340.

In step 320, a gloss-watermark pattern is produced in a selected area of the surface of a rotatable fixing member. In various embodiments, the surface roughness of the fixing member in the gloss-watermark pattern is different than the surface roughness of the fixing member outside the gloss-watermark pattern. The portion of the surface of the fixing member outside the selected area is referred to as the surround, regardless of its size or shape.

The surface roughness of the gloss-watermark pattern can be greater or less than the surface roughness of the fixing member in the surround. Surface roughness can be measured in various ways. $R_a$ is the integral of deviations of the surface from a smoothed average surface, or approximately the average. $R_z$ is the average delta between the highest five peaks and the lowest five peaks in sampling length, relative to a smooth averaged surface. $R_{max}$ is the maximum peak to valley in the sampling length, relative to a smooth averaged surface. In various embodiments, for the gloss-watermark pattern of the fixing member, the $R_a$ is greater than the $R_a$ of a selected surround region adjacent to the gloss-watermark pattern by at least about 1.25 microns, the $R_z$ exceeds that of the surround by at least about 6 microns, and the $R_{max}$ exceeds that of the surround by at least about 8 microns. In various embodiments, for the gloss-watermark pattern of the fixing member, the $R_a$ is less than the $R_a$ of the surround by about 1.25 microns or more, the $R_z$ is less than that of the surround by about 6 microns or more, and the $R_{max}$ is less than that of the surround by about 8 microns or more. In various embodiments, for the gloss-watermark pattern of the fixing member, $R_a$>0.15 μm, $R_z$ is greater than about 6 μm, and $R_{max}$ is greater than about 8 μm. $R_a$ can be >1.25 μm. Various methods of producing the gloss-watermark pattern are described below with respect to FIGS. 5 and 6.

Steps 320 and 310 are followed by step 340. Step 340 operates on marked receiver 330. The printed image includes toner, phase-change ink, or hot-melt ink. Various embodiments of printed-image formation are described above with respect to FIGS. 1 and 2.

In step 340, the printed image on marked receiver 330 is fixed or fused using the fixing member having the gloss-watermark pattern. As a result, a gloss watermark corresponding (and not necessarily identical in shape) to the gloss-watermark pattern is formed on the printed image.

In various embodiments, fixing includes heating the fixing member and applying pressure to the image-bearing portion of the receiver with the heated fixing member. The heat softens the marking material and the pressure causes the softened marking material to flow. As a result, the surface of the marking material visible to a viewer of the printed receiver acquires a certain texture (or lack thereof). This texture provides a gloss; smoother marking-material surfaces generally have higher gloss than rougher surfaces. Since the fixing member has the gloss-watermark pattern, a gloss is imparted to the marking material in a differentiated region on the receiver corresponding to the gloss-watermark pattern of the fixing member that is different than the gloss of the marking material outside the differentiated region. This gloss difference creates the gloss watermark on the surface of the marking material.

FIG. 4A is a plan of receiver 42B bearing a gloss watermark according to an example. Image content 410, represented graphically as a series of parallel lines, is the non-gloss-watermark content of the print. In an example, image content 410 includes all the marking material deposited on receiver 42B, considered without regard to viewing angle. In this example, image content 410 is also present between the parallel lines. For clarity, this content is not depicted.

Differentiated region 420 is a region on receiver 42B in which marking material 238 or 279 (FIG. 2) has a particular gloss. The gloss of marking material 238 in differentiated region 420 is different than the gloss of the marking material outside differentiated region 420. This difference creates the gloss watermark on the surface of marking material 238: at certain viewing angles, the difference in gloss is visible, and the shape of differentiated region 420 can be seen. Differentiated region 420 corresponds to selected area 215 (FIG. 2) of fixing member 262 (FIG. 2). The area outside differentiated region 420 corresponds to surround 299. The marking material can be the marking material of image content 410, or can be clear or other marking material deposited for use in forming the gloss watermark.

FIG. 4B is a side view of receiver 42B. In this example, the gloss of marking material 238 in differentiated region 420 is less than the gloss of marking material 238 outside differentiated region 420. Ray 431 shows the path of incident light from a 60° glossmeter. Ray 432 shows the path of the reflected light. Outside differentiated region 420, the reflection is largely specular, and the surface has high gloss. Inside differentiated region 420, incident ray 433 results in diffuse-reflection (rays 434). The surface has low gloss.

FIG. 4C is a side view of receiver 42B. In this example, the gloss of marking material 238 in differentiated region 420 is greater than the gloss of marking material 238 outside differentiated region 420. Outside differentiated region 420, incident ray 441 produces diffuse-reflection rays 442. Inside differentiated region 420, incident ray 443 produces specularly-reflected ray 444. The gloss of the surface inside differentiated region 420 (specular reflection) is higher than the gloss outside (diffuse reflection).

In various embodiments, differentiated region 420 occupies more than 25% of the area of the receiver. In various embodiments, the differentiated region includes multiple disconnected segments.

Figure 5:
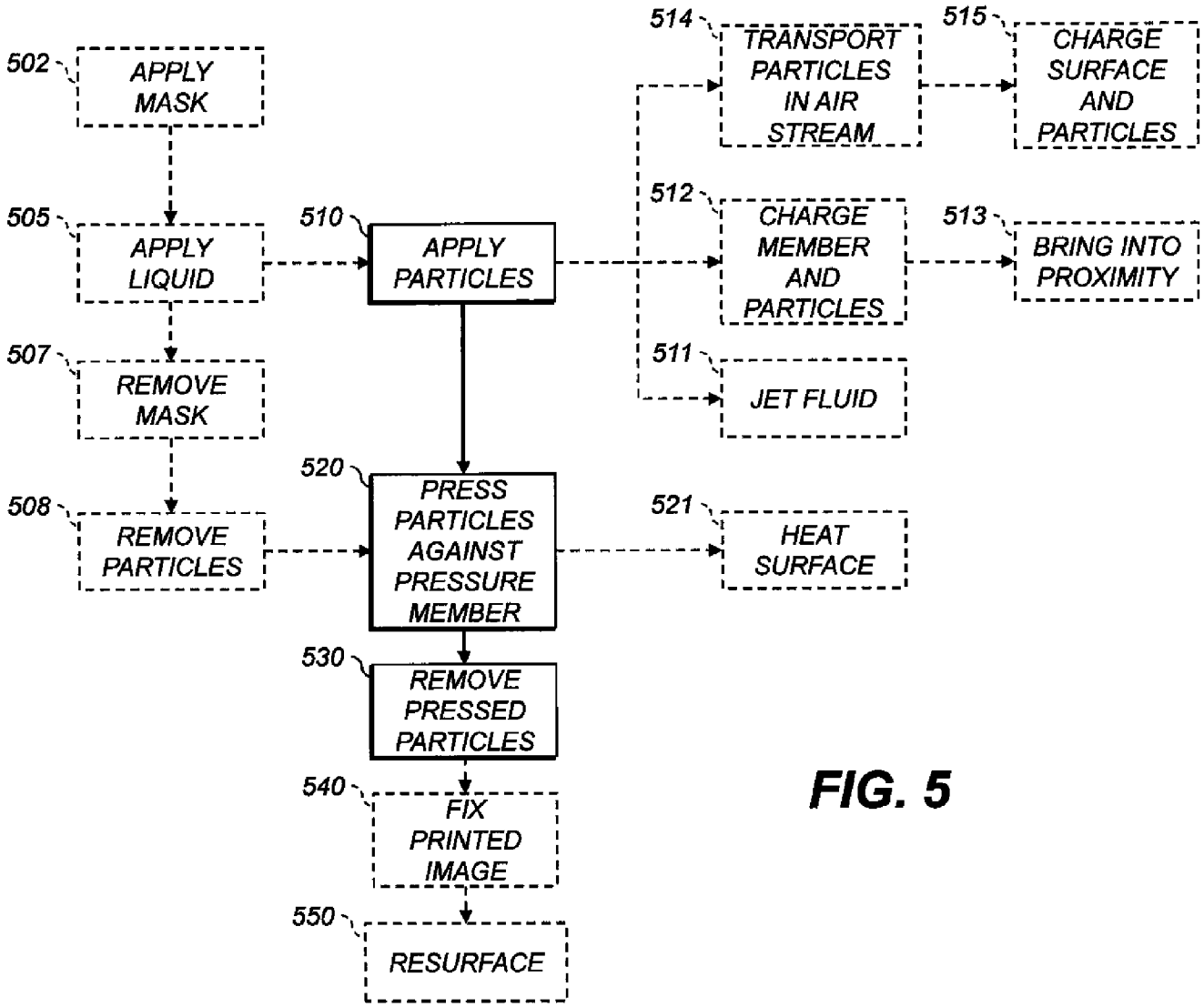
FIGS. 5 and 6 show various methods of producing a gloss-watermark pattern on a rotatable fixing member.

FIG. 5 shows various methods of producing a gloss-watermark pattern on a rotatable fixing member. The fixing member includes a thermoplastic layer, which can be crystalline, semicrystalline, or amorphous. For example, the layer can be a semicrystalline fluoroplastic. The layer has a surface and a selected thickness. In various embodiments, the member is a roller including a hard core and a coaxial thermoset (e.g., elastomeric silicone or epoxy) layer between the hard core and the thermoplastic layer. For example, the thermoplastic can be perflouroalkoxy ether (PFA), the thermoset can be elastomeric silicone, and the hard core can be metal. A compliant PFA can also be used, as described in U.S. Publication No. 2011/0159276, published Jun. 30, 2011, incorporated herein by reference. In other embodiments, the member is a metal or other rigid cylinder coated with the thermoplastic layer, and optionally with an adhesion-promoting layer between the metal and thermoplastic. In various embodiments, the surface (or the topcoat) of the fixing member has low surface energy to permit oil-less fusing with effective substrate release. The surface can be a high-temperature tolerant thermoplastic, such as FEP, PFA, or PTFE described in U.S. Published Applications 2007/0298252, 2007/0298251, 2007/0298217, and 2007/0296122 each of which were published on Dec. 27, 2007; U.S. 2010/0151068, published Jun. 7, 2010; and each of which is incorporated herein by reference.

Processing begins with optional step 502 and with step 510.

In step 510, particles having a Young's modulus of at least 1 GPa are applied in a selected deposition pattern to a selected area of the surface. The particles can include salt, ceramic, metal, or toner particles. Toner particles are preferably in a glassy state when applied. The particles can be applied by depositing or dropping them onto the surface of the fixing member, by jetting them using a fluid jet as a carrier, by moving the fixing member through a bed of particles so that some are scooped up, or in other ways. The deposition pattern can be defined as the area in which the particles are applied, e.g., by jetting. Alternatively, the deposition pattern can be defined before applying the particles, e.g., by electrostatically charging the surface in the deposition area. Various embodiments of defining deposition patterns are discussed below. Step 510 is followed by step 520, and optionally step 511, step 512, or step 514.

In step 511, in various embodiments, applying step 510 includes using an inkjet engine to jet carrier fluid onto the surface. The carrier fluid has the particles mixed or suspended therein. In an example, the carrier fluid is a solution including humectant in water, deposited using a thermal or piezoelectric drop-on-demand inkjet engine. In another example, the carrier fluid is a silicone fluid, oil, organic solvent, or liquid chlorofluorocarbon, jetted using a piezoelectric inkjet engine. Silicone fluid can also be jetted using a thermal inkjet engine.

In step 512, in various embodiments, applying step 510 includes electrostatically charging the surface of the fixing member and electrostatically charging the particles. Step 512 is followed by step 513.

In step 513, the particles are brought into proximity with the surface of the fixing member so that the particles are drawn to the surface of the fixing member by electrical forces (e.g., Coulomb, Lorentz forces).

In step 514, in various embodiments, applying step 510 includes transporting the particles towards the surface in an air stream. A low-pressure jet can be passed through a nozzle. The particles can be small enough to behave as dust, e.g., similarly to ground cinnamon. Step 514 is followed by step 515.

In step 515, in various embodiments, applying step 510 further includes, before or while transporting the particles (step 514), electrically charging the surface of the fixing member and electrically charging the particles. This increases the attraction between the particles and the surface so that more particles will be retained by the surface when the air jet draws them into proximity therewith. In other embodiments, other forces of attraction can be used. For example, magnetic particles can be used, and a magnet can be placed with respect to the surface (e.g., in the core of a roller fixing member) to attract the particles to the surface. For particles that come into contact with the surface, van der Waals forces can hold the particles to the surface.

In step 520, the applied particles are pressed against a pressure member. The pressure member can be a roller, a plate, an anvil, or another object, and the pressure can be applied while the pressure member is rotating, translating, or stationary. The pressure causes the applied particles to indent the surface of the fixing member to form the gloss-watermark pattern. If toner particles are used, they are cooled below their glass transition temperature(s) Tg before pressing.

In various embodiments, the particles have sharp points that create localized high pressures under them when pressed. This pressure causes the thermoplastic to flow locally. Heat can be applied before or during pressing to soften the surface layer, i.e., to reduce the resistance of the thermoplastic to flowing. Consequently, pressing can be performed at relatively lower temperatures and relatively higher pressures, or at relatively higher temperatures and relatively lower pressures. The thermoplastic is preferably in a viscous state during pressing. After pressing, the gloss-watermark pattern exists. Gloss level corresponds to average roughness Ra; in various embodiments, a change in Ra of about 5 μin corresponds to a change in G60 gloss from about 10 to about 60. The Ra is preferably less than the thickness of the thermoplastic layer.

Embossing can occur when the stresses exerted on the thermoplastic layer exceeds the elastic limit of that layer, causing a plastic or viscoelastic deformation of the member in the pattern of the gloss watermark. The gloss-watermark pattern can remain on the roller after pressure is released for a certain time, depending on the viscoelastic properties of the thermoplastic layer or the temperature and pressure to which the layer is subjected. In various embodiments, the gloss-watermark pattern remains usable for at least several thousand prints.

The embossing depth, i.e., the depth of the gloss-watermark pattern after the particles are removed, can be between 0.2 μm and 10 μm. Larger or smaller depths can be produced. Since the wavelength of visible light is of the order of 0.5 μm, relatively larger embossing depths produce more readily-visible gloss watermarks than relatively smaller embossing depths. Relatively larger embossing depths require thicker thermoplastic layers than, and can trap more contaminants than, relatively smaller embossing depths.

Step 520 is followed by step 530 and optional step 521.

In various embodiments, the surface of the fixing member contains a semicrystalline material such as perfluoroalkoxy (PFA). Before or during the particle pressing (step 520), the fixing member is heated to a temperature in excess of that normally used in the fusing process (e.g., up to but not exceeding the melting temperature of the surface material of the fixing member). Upon cooling, the fusing member retains the embossed variable surface roughness from the particles.

In step 521, in various embodiments, pressing step 520 includes heating the surface. The surface can be heated from inside (e.g., a coaxial lamp heater), from outside, or by heating the pressure member. Heating the surface can lower the pressing force required to produce the gloss-watermark pattern. In some embodiments using toner particles, this step is not used; pressing while cold reduces the probability of the particles melting and smearing.

In step 530, at least some of the pressed particles are removed from the surface. In various embodiments, the particles are rinsed, wiped, or skived off the surface of the fixing member. Other embodiments of removing particles are described below. Step 530 is followed by step 540.

In optional step 502, in various embodiments, a physical or mechanical mask is applied to the surface or arranged with respect to the surface to define the selected area. This is done before applying-liquid step 505. In various embodiments, the mask has an aperture and a surround. Liquid can be applied to cover the open area defined by the aperture, or to cover only part of that area. In various embodiments, the applying step 510 includes applying particles over the aperture and at least part of the surround. An example is given below with respect to step 507. Step 502 is followed by step 505.

In step 505, in various embodiments, before applying the particles (step 510), a liquid is applied to at least some of the selected area of the surface. The liquid has a surface tension less than or equal to the quantity 10 erg/cm$^2$ plus the surface energy of the surface. The liquid can be fuser oil or any other liquid that will neither bead up on nor damage the surface. When the particles are applied over the liquid, the liquid retains at least some of the applied particles in operative arrangement with the surface to indent the surface during the pressing step. The retained particles can be in contact with, or spaced apart from, the surface. The liquid can hold particles in suspension off the surface. The liquid can hold the particles by van der Waals forces, e.g., capillary forces. In various embodiments, the particles are free to move around on the surface or drift in the liquid, but are confined to the extent of the liquid, and the extent of the liquid defines the deposition pattern. In various embodiments, the pressure member used in pressing step 520 includes channels, holes, or other features permitting the liquid to escape from between the pressure member and the surface while the particles are being pressed. Step 505 is followed by step 510 and step 507.

In step 507, in embodiments using step 502, the mask is removed from the surface or from arrangement therewith before the pressing step. In an example of applying particles using a mask, the mask defines the selected area and the deposition pattern. After the mask is applied to the surface (step 502), the aperture of the mask, e.g., the shape of differentiated region 420 (FIG. 4A), is covered with liquid, so that the liquid wets the surface of the fixing member to form the shape of, e.g., the letter K. The mask is then removed (step 507), and particles are applied (step 510), e.g., by moving the fixing member under a falling curtain of particles or through an open vessel of particles. Steps 507 and 510 can be performed in either order. If step 507 is performed second, particles that overflow the aperture are lifted off with the mask. Step 507 is followed by step 508.

In step 508, in various embodiments, after removing the mask (step 507), excess particles are removed. Removal can be accomplished by blowing off the surface, vacuuming the surface, jetting liquid over the surface, orienting the surface so that excess particles fall off under the influence of the Earth's gravity, applying an electric, magnetic or electromagnetic field to draw charged or magnetic particles off the surface, applying a weak adhesive on a backer to the surface and removing the backer to pull the adhesive and particles with it (e.g., 3M POST-IT adhesive), brushing off the particles with a rotating or stationary brush, or scraping the particles off with a skive. In various embodiments, this step is not used; for example, when the liquid is applied only in the deposition pattern, and particles do not adhere to any dry portion of the surface, particles are only present in the area where the gloss-watermark pattern will be formed, so step 508 is not used. Step 508 is followed by step 520.

In step 540, in various embodiments, after the removing step, a printed image is fixed on a receiver using the fixing member having the gloss-watermark pattern. The printed image includes toner, phase-change ink, or hot-melt ink. As a result, a gloss watermark corresponding to the gloss-watermark pattern is formed on the printed image. The gloss watermark is not necessarily identical in shape to the gloss-watermark pattern. The fixing is performed at lower temperature, or at lower pressure, than the pressing (step 520). The fixing temperature and pressure are selected so that the thermoplastic layer will not flow a significant amount over the number of prints to be fixed and the particular fixing conditions.

In an example, PFA can be annealed at from 280 to 320° C. Fixing is performed at 230° C. or less. Consequently, a gloss-watermark pattern formed in a PFA thermoplastic layer is not destroyed or altered beyond recognition during the fixing of a single print. However, small changes in the gloss-watermark pattern can accumulate over time. To maintain watermark quality, the fixing member can be annealed (step 550) and re-impressed (steps 510-530). The gloss-watermark pattern can be refreshed in this way every time a selected number of prints have been made, e.g., a number from 50,000 to 100,000 prints. Step 540 is followed by step 550.

In step 550, in various embodiments, after removing step 530 or fixing step 540, a heated resurfacing member is pressed against the surface of the fixing member. This anneals the surface so that the gloss-watermark pattern is removed from the surface. Annealing is described below with reference to FIG. 7.

Figure 6:
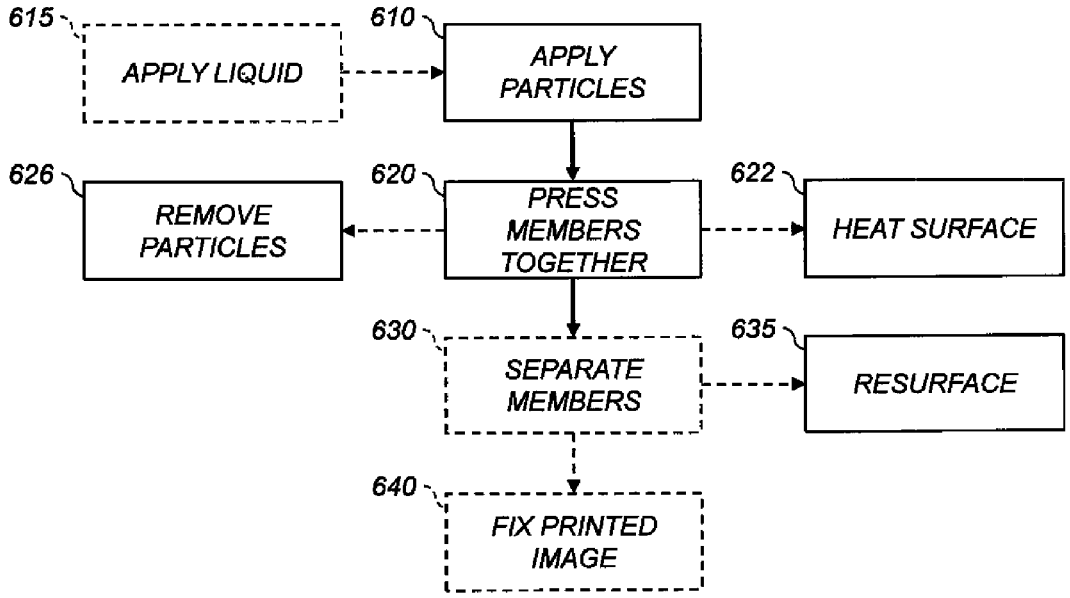

FIG. 6 shows methods of producing a gloss-watermark pattern on a rotatable fixing member. The fixing member includes a thermoplastic layer having a surface and a selected thickness, as described above. Processing begins with step 610 and optional step 615.

In step 610, particles having a Young's modulus of at least 1 GPa, as described above, are applied in a selected deposition pattern to a selected area of a pressure member. The pressure member can be a roller, plate, or anvil, as described above. Step 610 is followed by step 620.

In optional step 615, before applying particles (step 610), a liquid is applied to at least some of the selected area of the pressure member. The liquid has a surface tension less than or equal to the quantity 10 erg/cm$^2$ plus the surface energy of the surface of the pressure member in the selected area. Liquid application, masking, and removal are as described above. When the particles are applied, the liquid retains at least some of the applied particles in operative arrangement with the surface of the pressure member to indent the surface of the fixing member during the pressing step. Step 615 is followed by step 610.

In step 620, the pressure member and the fixing member are pressed together. Either or both can be moved. The members are pressed together with sufficient force to press the applied particles on the pressure member against the fixing roller so that the applied particles indent the surface of the fixing member to form the gloss-watermark pattern. Step 620 is followed by step 630, step 622, and step 626.

In step 622, in various embodiments, pressing step 620 includes heating the surface of the fixing member, as described above.

In step 626, in various embodiments, at least some of the pressed particles are removed from the surface of the fixing member. Removal can be performed as described above. Various embodiments remove any particles stuck to the surface of the fixing member or that have become embedded therein.

In step 630, the pressure member and the fixing member are mechanically separated. Step 630 is followed by step 640 and step 635.

In step 635, in various embodiments, after separating step 630, a heated resurfacing member is pressed against the surface to anneal the surface so that the gloss-watermark pattern is removed from the surface, as described above.

In step 640, after the separating step, a printed image is fixed on a receiver using the fixing member having the gloss-watermark pattern. The printed image can include toner, phase-change ink, or hot-melt ink, as described above. A gloss watermark corresponding to the gloss-watermark pattern is formed on the printed image during fixing.

Figure 7:
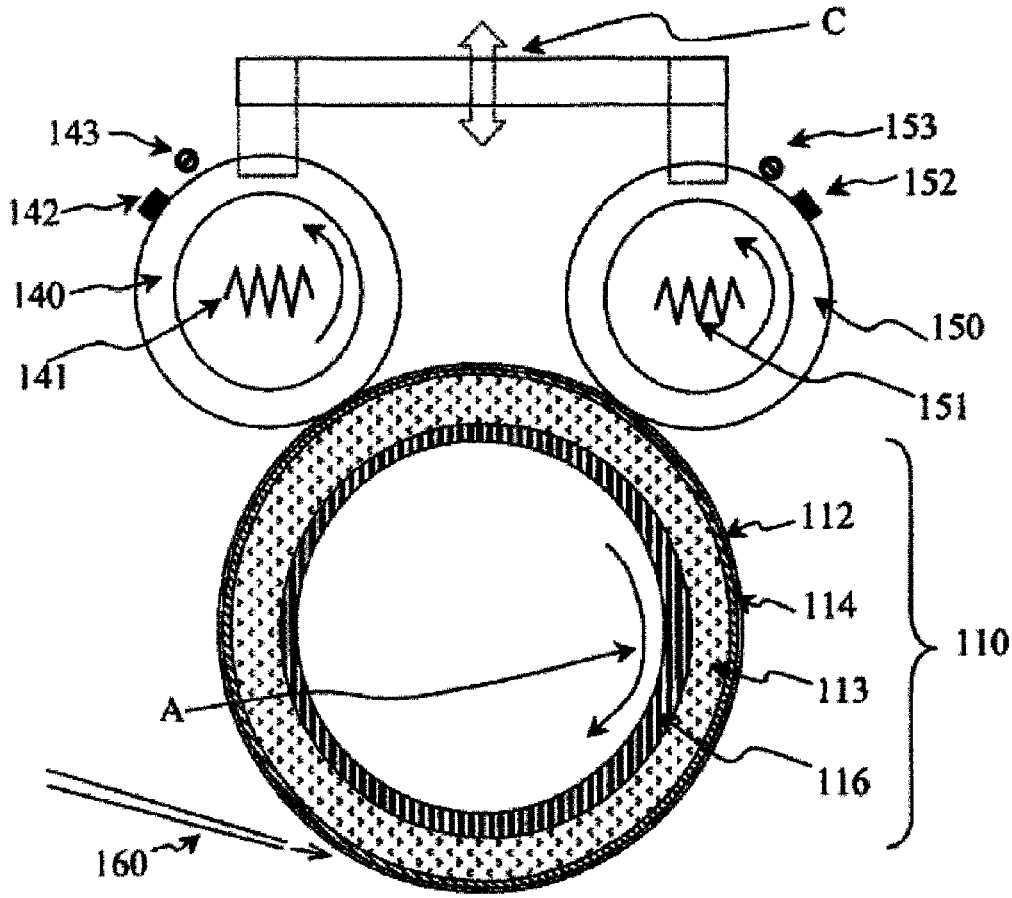
FIG. 7 shows an elevational cross-section of apparatus for annealing the surface of a fixing member according to various embodiments.

FIG. 7 shows an elevational cross-section of apparatus for annealing the surface of a fixing member according to various embodiments. Various embodiments can be applied to refurbishing fixing members with thermoplastic topcoat materials, such as FEP (polyfluorinated ethylene-propylene), PFA (perfluoroalkoxy-tetrafluoroethylene), or PTFE (polytetrafluoroethylene). These embodiments are not dependent on how the fuser member is manufactured, i.e., they are not affected by whether the topcoat is sleeve-molded, sintered with dispersion, sprayed or transfer-coated, or made in other ways. Further details are given in U.S. patent application Ser. No. 11/746,083, filed May 9, 2007, entitled "IN-LINE METHOD TO REFURBISH FUSER MEMBERS" (U.S. Publication No. 2008/0280035, published Nov. 13, 2008), and U.S. patent application Ser. No. 12/337,067, entitled "APPARATUS FOR REFURBISHING CYLINDRICAL MEMBERS" (U.S. Publication No. 2010/0151068, published Jun. 17, 2010), both of which are incorporated herein by reference.

In the example shown, fixing member 110 is cylindrically symmetrical, i.e., a cross-section of fixing member 110 taken at a right angle to the axis of rotation thereof anywhere along the length thereof has radial symmetry around the axis thereof.

Fuser member 110 has generally concentric central core 116 for supporting the plurality of the layers. Core 116 can be metallic, e.g., stainless steel, steel, or aluminum. The examples shown use an external heating source for fixing member 110, but an internal heating source can also be used. Various layers can be deposited above core 116, such as a resilient layer, also termed a cushion layer 113, tie layers, adhesion promotion layers, and primer layers 114 for bonding the cushion layer with the outmost layer 112. The outmost layer 112, is a toner release layer, which includes a thermoplastic fluoropolymer such as PTFE, PFA, or FEP, or blends thereof.

Heater rollers 140, 150 can be made of rigid materials, such as chromed steel. Temperature sensors 142, 152, the over-temperature ("over-temp") devices 143, 153, heating elements 141, 151, and heater rollers 140, 150 cooperate to heat outmost layer 112. Program-controllable loading assembly C selectively engages heater rollers 140, 150 with fixing member 110. The distances between over-temp devices 143, 153 and the surfaces of respective heater rollers 140, 150 are adjustable. Over-temp devices 143, 153 are operational at a temperature range up to around the melting point of the topcoat, permitting measurement at the relatively higher-temperature set points used for annealing and the relatively lower-temperature set points used in fixing. During annealing, over-temp devices 143, 153 are moved farther away from heater rollers 140, 150, to a pre-determined distance between 0.5 mm and 3 mm. This permits over-temp devices 143, 153 to operate as fusible safety devices for temperatures higher than normal fixing temperature set points. The heater roller engagement, temperature, and rotational speed of the fuser member are controlled to provide annealing.

Fixing member 110 can be a pressure or fuser plate, pressure or fuser roller, fuser belt, or any other member on which a release coating is applied. Core 116 can be a metal element with or without additional layers adhered to the metal element. The metal element can take the shape of a cylindrical core, plate or belt. The metal element can be made of, for example, aluminum, stainless steel or nickel. The surface of the metal element can be rough, but even relatively smooth surfaces of the metal element can achieve effective adhesion between the metal element and the layer attached to the metal element. The additional support layers adhered to the metal element can include layers of materials useful for fixing members, such as silicone rubbers, and adhesion promoter layers.

The fluoropolymer resin outmost layer 112 includes a fluoropolymer material, such as a semicrystalline fluoropolymer or a semicrystalline fluoropolymer composite. Such materials include polytetrafluoroethylene (PTFE), polyperfluoroalkoxy-tetrafluoroethylene (PFA), polyfluorinated ethylene-propylene (PEP), poly(ethylenetetrafluoroethylene), polyvinylfluoride, polyvinylidene fluoride, poly(ethylene-chlorotrifluoroethylene), polychlorotrifluoroethylene and mixtures of fluoropolymer resins. Some of these fluoropolymer resins are commercially available from DuPont as TEFLON or SILVERSTONE materials.

In various embodiments, the thermoplastic outmost layer 112 of fixing member 110 is simultaneously heated and pressurized. Outmost layer 112, or the surface thereof is heated to a temperature at least 10° C. below the melting temperature of the material of outmost layer 112, for example, from 280 to 320° C. for PFA and PTFE materials. A resurfacing member (e.g., heater rollers 140, 150) presses against outmost layer 112 at a pressure of at least 5 psi. In various embodiments, the core of the fixing member, the inside surface of the thermoplastic layer, or both are actively cooled. In various embodiments, the following steps are performed in order:

(1) Raise the temperature of heater rollers 140, 150 higher than that for normal printing operation, so that surface temperature of fixing member 110 is brought to at least 10° C. below the melt temperature of the materials of outmost layer 112;

(2) Move over-temp devices 143, 153 to a pre-determined distance suitable for the refurbishing temperature range, which is a higher temperature range than the normal printing mode set-points;

(3) Rotate fixing member 110 at a rotational speed at least 1 rpm, engage heater rollers 140, 150 therewith at a contact pressure of at least 5 psi and up to a needed temperature at least 10° C. below the melt temperature of the topcoat materials;

(4) Turn on cooling air through nozzle 160 to cool fixing member 110 at a position away from the nips between fixing member 110 and heater rollers 140, 150 to reduce the probability of overheating of the sublayers, and to provide rapid recovery to the normal printing mode set-points; and (5) Retain heater rollers 140, 150 in contact with the surface of fixing member 110 for a period of time sufficient to refurbish the fuser member, e.g., 1 to 3 minutes.

In various embodiments, before annealing, surfaces of fixing member 110 and heater rollers 140, 150 are cleaned. These surfaces should be free of contamination, such as, residual toner or deposit of foreign materials, such as from paper. Cleaning can be performed by non-invasive methods such as by applying solvents using soft rags. Cleaning of mild soil can also be performed by printing at least three receivers that are fully covered with toner (within the printable area) so that the toner itself takes away foreign materials.

Example

In an example, the fixing member was a fusing member with a 25-micron-thick PFA topcoat (melting temperature 305° C.), under which was 35-micron-thick Viton, under which was 200-mil-thick silicone rubber. The fixing member was used to fix 10,000 A4-sheet-equivalent prints on 300 μm-thick Tabloid-sized paper on a Nexpress 2100 printing press with externally-heated fuser (fixing) assembly, and subsequently showed de-glossing along the in-track paper edge on the topcoat. A subsequent print on a wider coated paper showed a gloss drop in G60 value by 20 points along the de-glossed edge of the fixing member. The fixing member was refurbished at temperature around 300 to 305° C. of the external heater rollers with a programmed pressure that started from 5 psi and increased to 30 psi for about 2 minutes in line to the extent that the paper edge de-glossing was not visible on the fuser member and the subsequent print on a wider coated paper showed non-measurable difference in G60 value on the print that contacted the Tabloid-sized paper edge area of the fuser member.

Figure 8:
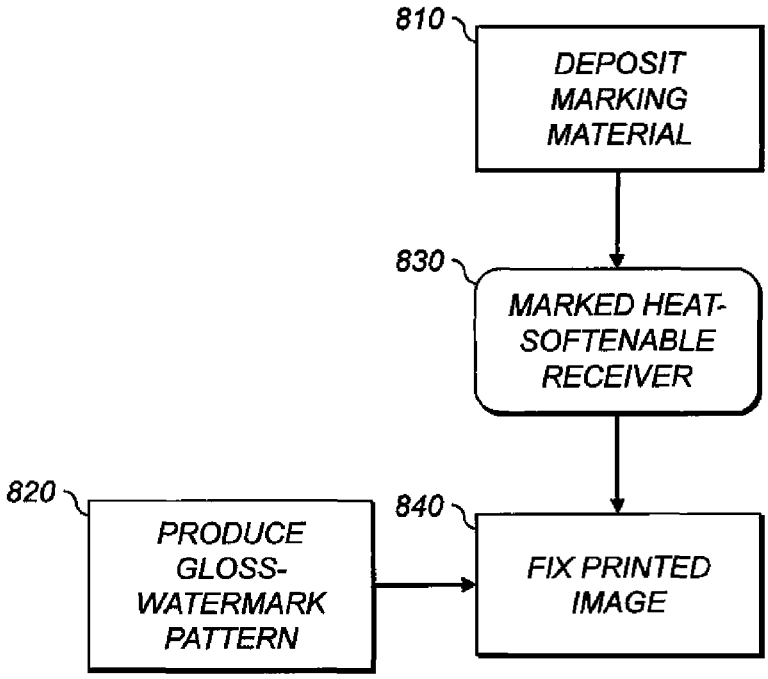
FIG. 8 illustrates an embodiment for producing gloss watermarks on receivers having a heat-softenable image-bearing surface.

FIG. 8 shows various embodiments of producing gloss watermarks on receivers 830 having heat-softenable image-bearing surface. Receiver 830 can be made from a thermoplastic material, or can include a thermoplastic layer adapted to receive marking material. For example, a marking material to be deposited can include dry toner particles having a toner binder and a particle size of less than 8 micrometers. A photoreceptor with a surface layer comprising a film-forming, electrically insulating polyester or polycarbonate thermoplastic polymeric binder resin matrix and a surface energy of not greater than approximately 47 dynes/cm, preferably from about 40 to 45 dynes/cm, can be used to retain the marking material in the desired pattern to be transferred to the receiver. Receiver 830 can include a substrate having a coating of a thermoplastic addition polymer (polymers that do not lose atoms during the polymerization reaction, e.g., polystyrene) on a surface of the substrate. The $T_g$ of the polymer is less than approximately 10° C. above the $T_g$ of the toner binder, and the surface energy of the thermoplastic polymer coating is approximately 38 to 43 dynes/cm. Further details of various receivers that can be used are given in U.S. Pat. Nos. 5,043,242 and 5,102,768, incorporated herein by reference. Processing begins in step 810.

In step 810, marking material is transferred to the image-bearing surface of receiver 830, as described above with reference to FIGS. 1-3 or in the cited '242 and '768 patents. The result is receiver 830. In step 820, the gloss-watermark pattern is produced on the fixing member, as described above with reference to FIG. 3. In step 840, after steps 810 and 820, the printed image on heat-softenable receiver is fixed as described above. As a result, receiver 830 is embossed with the gloss watermark. The gloss watermark will be visible both in areas on the image-bearing surface of receiver 830 with marking material and in areas without marking material. In various embodiments, this method produces gloss watermarks extending beyond the printed information on receiver 830 without using clear toner adjacent to the colored toner. After fixing, the fixing member can be annealed as described above to change the gloss watermark for a subsequent fixing operation.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

21 charger
21*a* voltage source
22 exposure subsystem
23 toning station
23*a* voltage source
25 photoreceptor
25*a* voltage source
31, 32, 33, 34, 35, 36 printing module
38 marking material
39 fused image
40 supply unit
42, 42A, 42B receiver
50 transfer subsystem
60 fixing station
62 fixing member
64 pressure member
66 fixing nip
68 release fluid application substation
69 output tray
70 finisher
81 transport web
86 cleaning station
99 logic and control unit (LCU)
100 printer
110 fixing member
112 outmost layer
113 cushion layer
114 primer layers
116 central core
140, 150 heater roller
141, 151 heating element
142, 152 temperature sensors
143, 153 over-temp device
160 nozzle
215 selected area
217 gloss-watermark pattern
220 heater
238 heat-softenable marking material
242 receiver
250 marking-material-bearing member

255 source
262 fixing member
264 pressure member
265 drive
266 fixing nip
270 jetting unit
277 solid marking material
278 molten marking material
279 solid marking material
299 surround
310 deposit heat-softenable material step
313 transfer marking material step
316 electrostatic transfer step
317 jet molten marking material step
320 produce gloss-watermark pattern step
330 marked receiver
340 fix printed image step
410 image content
420 differentiated region
431, 433, 441, 443 incident light ray
432, 444 specularly-reflected ray
434, 442 diffuse-reflection ray
502 apply mask step
505 apply liquid step
507 remove mask step
508 remove particles step
510 apply particles step
511 jet fluid step
512 charge member and particles step
513 bring into proximity step
514 transport particles in air stream step
515 charge surface and particles step
520 press particles against pressure member step
521 heat surface step
530 remove pressed particles step
540 fix printed image step
550 resurface step
610 apply particles step
615 apply liquid step
620 press members together step
622 heat surface step
626 remove particles step
630 separate members step
635 resurface step
640 fix printed image step
810 deposit marking material step
820 produce gloss-watermark pattern step
830 marked receiver
840 fix printed image step

The invention claimed is:

1. A method of producing a gloss-watermark pattern on a rotatable fixing member including a thermoplastic layer having a surface and a selected thickness, the method comprising:

applying particles having a Young's modulus of at least 1 GPa in a selected deposition pattern to a selected area of a pressure member; and pressing the pressure member and the fixing member together so that the applied particles indent the surface of the fixing member to form the gloss-watermark pattern.

2. The method according to claim 1, wherein the pressing step includes heating the surface.

3. The method according to claim 1, further including mechanically separating the pressure member and the fixing member.

4. The method according to claim 3, further including, after the separating step, fixing a printed image on a receiver using the fixing member having the gloss-watermark pattern, the printed image including toner, phase-change ink, or hot-melt ink, so that a gloss watermark corresponding to the gloss-watermark pattern is formed on the printed image.

5. The method according to claim 3, further including removing at least some of the pressed particles from the surface of the fixing member.

6. The method according to claim 3, further including, after the separating step, pressing a heated resurfacing member against the surface to anneal the surface so that the gloss-watermark pattern is removed from the surface.

7. The method according to claim 1, further including, before applying the particles, applying a liquid to at least some of the selected area of the pressure member, the liquid having a surface tension less than or equal to the quantity 10 erg/cm$^2$ plus the surface energy of the surface of the pressure member in the selected area, so that when the particles are applied, the liquid retains at least some of the applied particles in operative arrangement with the surface of the pressure member to indent the surface of the fixing member during the pressing step.

8. The method according to claim 1, wherein the applying step includes using an inkjet engine to jet carrier fluid onto the surface, the carrier fluid having the particles mixed or suspended therein.

9. The method according to claim 1, wherein the applying step includes charging the surface of the fixing member, charging the particles, and bringing the particles into proximity with the surface of the fixing member so that the particles are drawn to the surface of the fixing member.

10. The method according to claim 1, wherein the member is a roller including a hard core and a coaxial thermoset layer between the hard core and the thermoplastic layer.

11. The method according to claim 1, wherein the particles are salt particles.

12. The method according to claim 1, wherein the gloss-watermark pattern has an average roughness less than the thickness of the thermoplastic layer.

* * * * *